United States Patent [19]

Vogel

[11] 4,133,107

[45] Jan. 9, 1979

[54] TOOL AND METHOD FOR MAKING THE SAME

[75] Inventor: Kurt A. Vogel, Lisle, Ill.

[73] Assignees: Donald Eugene Vogel; David Scott Vogel, both of Lisle, Ill.

[21] Appl. No.: 830,599

[22] Filed: Sep. 6, 1977

Related U.S. Application Data

[63] Continuation of Ser. No. 703,279, Jul. 7, 1976, abandoned.

[51] Int. Cl.[2] ..... B26B 13/00

[52] U.S. Cl. ..... 30/266; 76/104 A

[58] Field of Search ..... 30/254, 266, 267, 260; 76/104 A

[56] References Cited

U.S. PATENT DOCUMENTS

| | | | |
|---|---|---|---|
| 865,918 | 9/1907 | Ladd | 30/266 |
| 2,434,268 | 1/1948 | Hartkopf | 76/104 A |

FOREIGN PATENT DOCUMENTS

| | | | |
|---|---|---|---|
| 136694 | 3/1950 | Australia | 30/254 |
| 1303142 | 7/1962 | France | 30/266 |

*Primary Examiner*—Jimmy C. Peters

*Attorney, Agent, or Firm*—Allegretti, Newitt, Witcoff & McAndrews

[57] ABSTRACT

An improved tool, such as a scissors, shears and the like, and an improved method of making such a tool is disclosed. The improved tool comprises two cooperating members that are interconnected so as to be pivotally movable, with respect to each other and about a connection point, between an open position and a closed position. The members each have a handle at their one end, a shank portion disposed between its handle and the connection point, and a blade portion disposed between the connection point and their other end. Each of the shank portions of the members have an inside face and an outside face, and each of the blade portions of the members have an inside face, an outside face and a cutting edge extending from adjacent to the connection point and to the other end of the member.

During the practice of the improved method, the outside face of the shank portion of one of the members is punched so that a bearing dimple is formed on the inside face of this shank portion. The bearing dimple projects from and above the surface of the inside face of the shank portion of the one member so that the bearing dimple may contact the inside face of the shank portion of the other member as the first and second members are moved toward their closed position and so that there is point contact between the cutting edges of the members as the members are moved toward their closed position.

12 Claims, 14 Drawing Figures

TOOL AND METHOD FOR MAKING THE SAME

This is a continuation of application Ser. No. 703,279 filed July 7, 1976, now abandoned.

BACKGROUND AND SUMMARY OF THE INVENTION

This invention relates to an improved tool, such as scissors, shears and the like, and to an improved method for making such an improved tool.

From the first, scissors, shears and like tools have included two cooperating members that are innerconnected, by a pivot pin, bolt and nut, rivet, screw or the like, at a connection point located between their ends, so that the members can be moved, with "scissors-like" action, between a closed position and an open position. Each of the members commonly have a handle formed at their one end, a shank portion disposed between the handle and the connection point, i.e., the pivot pin, bolt and nut, rivet, screw, etc., and a blade portion disposed between the connection point in their other end. The blade portions and the shank portions each have an inside face and an outside face. The blade portions also include cutting edges which usually extend from adjacent to the connection point to their other ends. The members are generally arranged so that when they are in their closed position, the two inside faces of the blade portions and the two inside faces of the shank portions at least partially overlap and are adjacent to each other.

For many years, the manufacture of scissors, shears and like tools, and especially high quality tools, has required a significant amount of skilled hand work and particularly hand grinding operations. These hand grinding operations include the shaping and sharpening of the inside and outside faces and the cutting edges.

One of the most critical and time consuming of these hand grinding operations was the grinding of the surface or the "ride" of the inside faces of the shank portions so that when these inside faces are moved into contact with each other, as when the members are moved from their open to their closed position, the blade portions will be biased together so as to provide a satisfactory cutting or shearing action. When the hand grinding operation has been properly done, there only will be a "point contact" or "point of contact" between the cutting edges of the members. The artisans doing this critical hand grinding operation always attempt to grind the inside faces of the shank portions so that this point contact between the cutting edges is initially located near the point of initial intersection between the cutting edges and then moves out, along the cutting edges, to their other distal ends as the members are moved to their closed position. Ideally, this critical hand grinding operation should also impart a desirable "feel" to the tool, i.e., require a constant force to move the members from their open position to their closed position.

It has long been recognized by those skilled in this art that the hand grinding of the inside faces of the shank portions by skilled artisans was one of the most time consuming and thus expensive operations involved in the manufacture of scissors, shears and like tools. Nevertheless, the art has continued to utilize such a hand grinding operation. This is not to say, however, that others in the art have not suggested tools or methods of manufacture which do not require this critical hand grinding operation. For example, the Conover U.S. Pat. No. 222,672; the Wheeler U.S. Pat. No. 565,193; the Chapin U.S. Pat. No. 947,626; the Ladd U.S. Pat. No. 865,918; the Wertepny et al U.S. Pat. No. 2,600,236; the Rothstein U.S. Pat. No. 2,828,541; and the Sommervell et al U.S. Pat. No. 3,460,251 disclosed structure that was apparently intended to overcome this long standing problem in the art. However, as noted above, the art has continued to rely on the expertise of skilled artisans to perform the critical hand grinding of the inside faces of the shank portions of the members of the tools.

One of the principal objects of my present invention is to provide an improved, high quality tool, such as scissors, shears or the like, which does not require any significant hand grinding of the inside faces of the shank portions of the members in order to achieve point contact between the cutting edges of the members and which accordingly can be manufactured at a relatively low cost, as compared to tools and manufactured utilizing the heretofore conventional hand grinding operation. Another principal object of my present invention is to provide an improved method of manufacturing an improved tool, such as a scissors, shears or the like, wherein a simple punching operation is utilized, instead of the critical hand grinding operation that was heretofore required, in order to obtain a satisfactory high quality tool.

More specifically, the improved tool of my present invention includes first and second cooperating members. Each of these members have a handle on their one ends and are interconnected, at a connection point located intermediate their ends, by a screw, pivot pin, rivet or the like, so that the members may pivotally move about the connection point between an open position wherein the two handles and the other ends of the members are spaced apart and a closed position wherein the two handles are adjacent to each other and the other ends of the members are adjacent to each other. Shank portions are disposed on each of the first and second members between their handles and the connection point, and each shank portion includes an outside face and inside face. Blade portions are disposed on each of the first and second members between the connection point and the other ends of the members and each includes an inside face, an outside face, and a cutting edge that extends from adjacent to the connection point to the other end of the member. The members are constructed and arranged so that as the members are moved from their open position to their closed position, the inside faces of the shank portions overlie or overlap each other and are adjacent to each other.

A novel bearing dimple is formed in the inside surface of one of the shank portions by using a conventional punch tool to punch the outside face of the shank portion. This bearing dimple projects above and from the surface of the inside face of the one shank portion and is adapted to contact the inside face of the other shank portion as the first and second members are moved from their open position to their closed position. The contact between the bearing dimple and the inside face of the other shank portion biases or "tilts" the one ends of the members apart, about the connection point, so that there will be "point contact" between the cutting edges of the first and second members. The bearing dimple is disposed, vis-a-vis, the connection point so that the initial "point contact" or "point of contact" between the cutting edges is adjacent the connection point as the cutting edges first intersect during the movement of the first and second members from their open position to their closed positions. This "point of contact" then moves out along the cutting edges to the other ends of the members as the first and second members continue to be moved to their closed positions. In practice, it has been found that especially satisfactory cutting or shearing results can be obtained when the distance between the bearing dimple and the connection point is at least equal to the distance between the connection point and the cutting edge.

As noted above, the utilization of a bearing dimple, instead of the heretofore required hand grinding operations on the inside faces of the shank portions, significantly reduces the time and cost of manufacturing a scissors, shears or other like tools without any impairment of the quality of the finished tool. In addition, my present invention affords another important advantage, from the standpoint of marketing my improved tool, since the invention enables all tools made utilizing such a bearing dimple to have the same "feel", viz., the same force is required to move the tools from their open to their closed positions. In contrast, tools made by the heretofore conventional hand grinding operation each had an individual "feel" since even a skilled artisan has difficulty grinding two separate tools exactly the same way.

The utilization of the novel bearing dimple of my present invention affords still another important advantage. One of the finishing steps in the manufacture of scissors, shears and like tools is the manual "setting" of the blades, i.e., bending the blades so that the cutting edges will properly meet. Again the uniformity of the height of the bearing dimples permits this "setting" operation to be done relatively quickly and easily and, of course, such minimumization of hand labor reduces the cost of manufacture.

In summary then, tools embodying my novel bearing dimple can be manufactured at a significantly lower cost since there is a marked savings in the time and manual labor required for manufacturing the tools. In addition, relatively unskilled laborers can be used to perform many of the manufacturing operations which heretofore required skilled, experienced artisans. Furthermore, improved tools of my present invention have an uniform "feel" which is a real advantage when the tools are utilized for industrial production work. Thus, my invention represents a significant breakthrough in this art and affords a practical solution to a long standing problem in the art.

These and other objects and advantages to my present invention will become apparent from the following description of the preferred embodiment of my invention, described in connection with the accompanying drawings.

Figure 1:
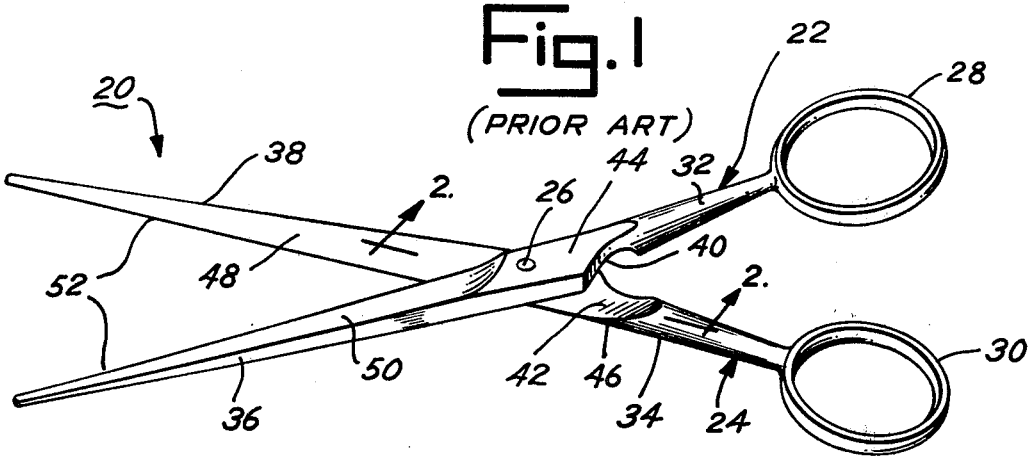
Fig. 1 (PRIOR ART)
FIG. 1 is a perspective view of a scissors manufactured by employing the heretofore conventional hand grinding operations on its shank portions and is an example of a typical high quality scissors that have heretofore been manufactured by the art.

Throughout the various figures of the drawings, the same reference numbers will be used to designate the same parts. However, when the terms "right", "left", "right end", "left end", "top" and "bottom" are used herein, it is to be understood that these terms have reference to structure shown in the drawings as it would appear to a person viewing the drawings.

DESCRIPTION OF THE PREFERRED EMBODIMENT

Figure 2:
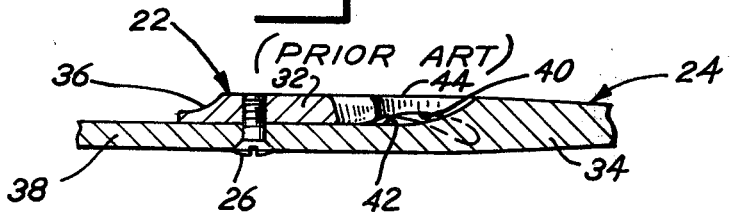
Fig. 2 (PRIOR ART)
FIG. 2 is a cross-sectional view taken along the line 2—2 in FIG. 1.

Referring now to the drawings, FIGS. 1 and 2 illustrate a scissors 20 which is an example of a high quality scissors made and used in the art prior to my invention. The scissors 20 comprises a first member 22 and a second member 24 which are innerconnected, between their ends, by a connector 26 which may, for instance, be a pin, a screw, a nut and bolt, a rivet or the like. Handles 28 and 30 are formed on the one ends of the members 22 and 24, respectively. Each of the members 22 and 24 have shank portions 32 and 34, respectively, disposed between the handles 28 and 30 and the connector 26 and blade portions 36 and 38, respectively, disposed between the connector 26 and other ends of the members. The shank portions 32 and 34 include inside faces 40 and 42, respectively, and outside faces 44 and 46, respectively. Each of the blade portions 36 and 38 has an inside face 48, an outside face 50 and a cutting edge 52. In a typical manner, the scissors 20 is designed for pivotal movement about the connector 26 between an open position, such as shown in FIG. 1, wherein the handles 28 and 30 are spaced apart and a closed position wherein the handles 28 and 30 are adjacent to and in contact with each other and wherein the inside faces 40 and 42 of the shank portions 32 and 34 overlap and are adjacent to each other.

As noted above, a conventional step in the manufacture of scissors, such as scissors 20 has been to hand grind the inside faces 40 and 42 so as to provide these faces 40 and 42 with a curved surface or "ride", such as shown in FIG. 2. More specifically, these surfaces must be ground so that when they come into contact with each other, as the scissors is moved to its closed position, the members will be biased away from each other about the connector 26 so that there will be point contact between the cutting edges 52 of the members. Skilled artisans have had to be used to do this hand grinding operation since it was critical, in high quality scissors, that the curved surfaces or "ride" of the faces 40 and 42 were properly ground so that the point contact between the cutting edges 52 was initially located adjacent to the point where the cutting edges first intersected, as the members were moved toward their closed position, this point contract would thereafter move outwardly along the cutting edges to the other end of the members as the members were moved to their closed position.

Figure 10:
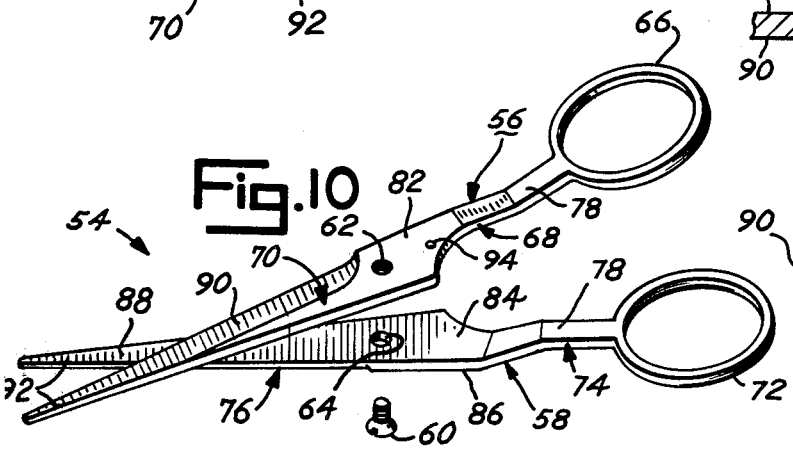
FIG. 10 is an exploded view showing an improved scissors of the present invention ready for final assembly.

The improved scissors of my present invention, shown generally at 54 in FIG. 10, provides the same high quality cutting or shearing action as the prior art scissors, exemplified by scissors 20. However, these improved scissors 54 do not require the time consuming and thus expensive hand grinding of the inside faces of their shank portions that was heretofore an essential part of the manufacturing operation for high quality scissors. As best seen in FIG. 10, the scissors 54 includes two members 56 and 58 which are structurally identical and which are innerconnected, intermediate their ends, by a connector, such as a screw 60, which is disposed in two holes 62 and 64 formed in the members 56 and 58, respectively. One or both of the holes 62 and 64 may be threaded so as to secure the screw 60 therein, and of course, other conventional connectors, such as for example a rivet, pin or nut and bolt, could be utilized in place of the screw 60

The member 56 has a handle 66 formed on its one end, a shank portion 68 disposed between the handle 66 and the hole 62, and a blade portion 70 disposed between the hole 62 and the other end of the member 56. Similarly, the member 58 has a handle 72 formed at its one end, a shank portion 74 disposed between the handle 72 and the hole 64, and a blade portion 76 disposed between the hole 64 and the other end of the member. The members 56 and 58 are arranged so that they may pivotally move, about the axis of the screw 60, i.e., the axes of the holes 62 and 64, between an open position wherein their handles 66 and 72 are spaced apart and closed position wherein the handles 66 and 72 are adjacent to and in contract with each other. Because the members 56 and 58 are structurally identical, the parts of the shank portions 68 and 74 are offset, as shown at 78, so as to facilitate the members moving between their open and closed positions.

The shank portion 68 includes an inside face 80 and outside face 82, and the shank portion 74, likewise, includes an inside face 84 and an outside face 86. As in scissors 20, the shank portions 68 and 74 of the scissors 54 are designed so that when the members 56 and 58 are moved from their open position to their closed position, the inside faces 80 and 84 of the shank portions 68 and 74 overlap and are adjacent to each other, i.e., the surfaces of the faces 80 and 84 are generally parallel to one another and overlie each other, with the degree of overlap being, of course, depending on how far the scissors members have been moved toward their closed position.

Each of the blade portions 70 and 76 include an inside face 88, an outside face 90 and a cutting edge 92. The inside faces 88 overlap and are adjacent to each other when the scissors 54 is in its closed position.

Figure 8:
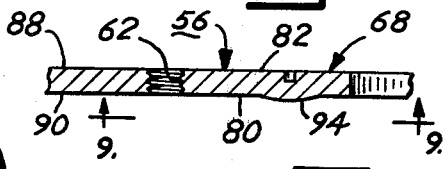
FIG. 8 is partial cross-sectional view taken along the line 8—8 in FIG. 7.
Figure 9:
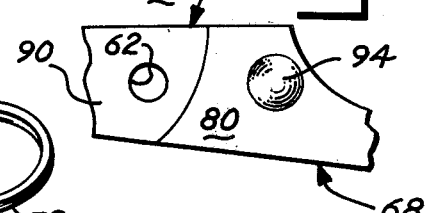
FIG. 9 is a bottom plan view taken along the line 9—9 in FIG. 8.

As illustrated in FIGS. 8–10, a bearing dimple 94 is integrally formed on the inside face 80 of the shank portion 68. This bearing dimple 94 projects from and above the surface of the inside face 80 so that when the inside faces 80 and 84 overlap, there is point contact between the bearing dimple 94 and the surface of the inside face 84.

Figure 11:
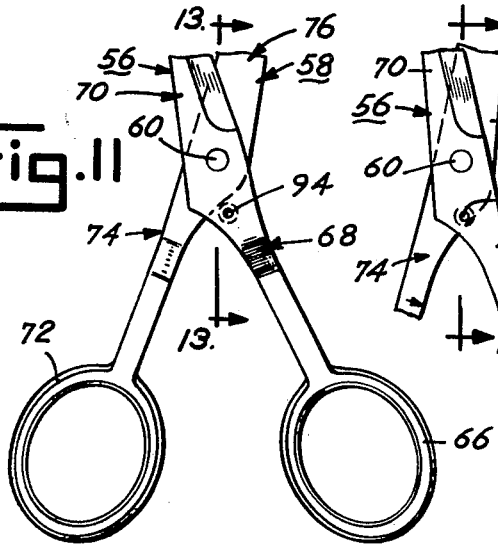
FIG. 11 is a partial top plan view of an improved scissors of the present invention showing the scissors members as they are initially moved from their open position to their closed position.
Figure 12:
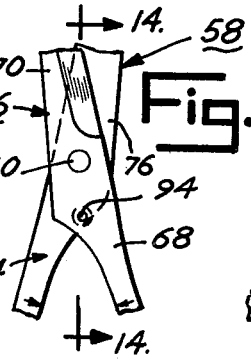
FIG. 12 is a partial plan view similar to that in FIG. 11 showing the scissors members after the scissors members have been further moved from their open position toward their closed position.
Figure 13:
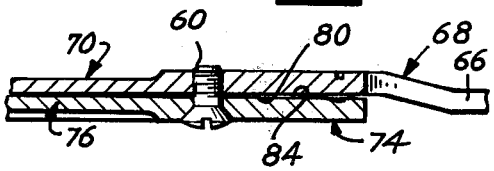
FIG. 13 is a partial cross-sectional view taken along the line 13—13 in FIG. 11.
Figure 14:
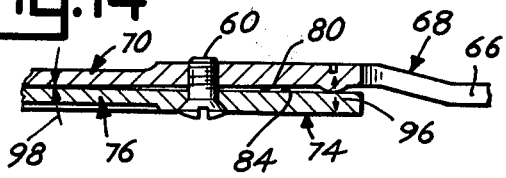
FIG. 14 is a partial cross-sectional view taken along the line 14—14 in FIG. 12.

FIGS. 11 and 13 show the relative positions of the members 56 and 58 just prior to the members 56 and 58 being moved so that the bearing dimple 94 is in point contact with the inside face 84 of the shank portion 74 and illustrate that without this point contact, the inside faces 80 and 84 are disposed generally parallel to each other. However, as best shown in FIGS. 12 and 14, when the bearing dimple 94 contacts the inside face 84 of the member 58, the shank portions 68 and 74 are forced apart, about an axis which is coaxial with the longitudinal axis of the screw 60, i.e., generally perpendicular to the planes of the inside faces 80 and 84, as indicated by the arrows 96 in FIG. 14. This biasing or "tilting" of the shank portions 68 and 74 results in the blade portions 70 and 76 being forced together, as indicated by the arrows 98 in FIG. 14, so that there is point contact between the cutting edges 92 of the members 56 and 58.

By properly positioning the bearing dimple, vis-a-vis the screw 60 and the sides of the member 56, this point contact between the cutting edges 92 will initially be adjacent to the point where the cutting edges first intersect as the members 56 and 58 are moved from their open position to their closed position and then will move out along the cutting edges 92 to the other ends of the members 56 and 58. In this regard, it has been found that when the distance between the bearing dimple 94 and the hole 62 is equal to or greater than the distance between the hole 62 and the cutting edge 92, i.e., the side of the member 56 in which the cutting edge 92 is formed, superior cutting or shearing action is obtainable.

Referring now to FIGS. 3–9, an improved method for making the scissors 54 will be described. However, since the members 56 and 58 are structurally identical, except for the bearing dimple 94, only the method of making member 56 is described in detail, and it should be remembered that member 58 is made by the same method except that the punching operation which forms the dimple 94 is omitted.

Figure 3:
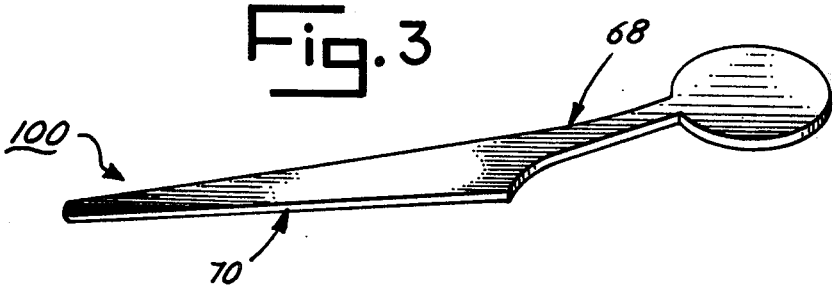
FIG. 3 is a perspective view of a blank of one of the members utilized in a scissors and shows the blank in an early stage of manufacture.
Figure 4:
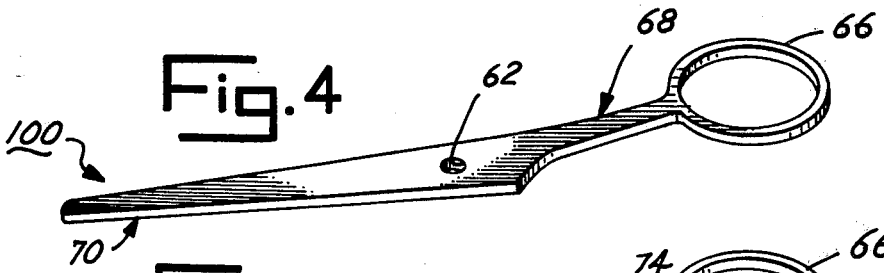
FIG. 4 shows the blank of FIG. 3 after a handle hole and a hole for receiving the pivot pin, rivet, screw and nut, etc. have been punched therein.
Figure 5:
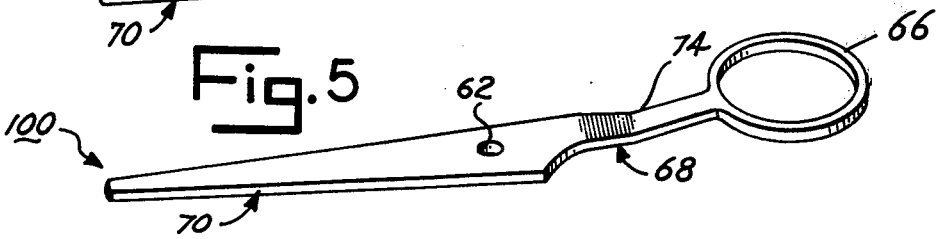
FIG. 5 shows the blank of FIG. 4 after it has been off-set by a punching operation.
Figure 6:
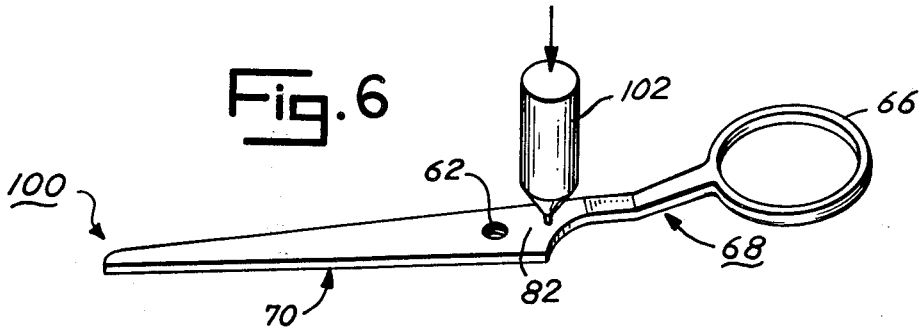
FIG. 6 shows the blank of FIG. 5 having a bearing dimple punched therein by a conventional punch tool.

As shown in FIG. 3, the member 56 is made from a metal blank 100 that is punched out of a steel sheet, preferably stainless steel sheet, by a conventional punch press. Because of the use of the bearing dimple 94, the blank 100, i.e., the sheet, does not have to be as thick as a blank used for a comparable prior art scissor since only minimal grinding of the blank is required. Next the finger hole for the handle 66 and the hole 62 are punched out of the blank 100, as shown in FIG. 4, on a punch press. The shank portion 68 of the blank 100 is then "offset", as at 74 and as best seen in FIG. 5, on a punch press so that the two members 56 and 58 can fit together when they are connected by the screw 60. The hole 62 is then threaded and countersunk.

Figure 7:
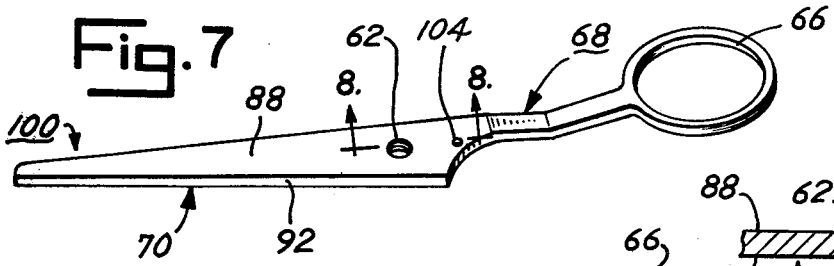
FIG. 7 shows the blank of FIG. 6 after the bearing dimple has been punched therein.

The bearing dimple 94 is next "punched" into shank portion 68 of the blank 100 by striking the outside face 82 with a conventional punch shown at 102 in FIG. 7. The punch 102 makes an indentation 104 in the outside face 82 and forms the bearing dimple 94 in the inside face 80. By controlling or regulating the force applied to the punch 102, bearing dimples 94 having the same "height" above or from the surface of the face 80, can be formed on a series of blanks. This uniformity of dimple "height" results in the scissors that are made from such a series of blanks, having a uniform "feel" which, as noted bove, is an advantgeous feature for the scissor to have from the standpoint of commercializing the scissors.

The blank 100 and particularly its blade portion 70, is then given a conventional heat treatment such as the standard "ice tempering" treatment. Thereafter the inside and outside faces 88 and 90 and the cutting edge 92 of the blade portion 70 are ground and finished. This grinding operation includes shaping the point of the blade portion 70.

Lastly the blank 100, now actually the member 56, is buffed and polished and is ready for assembly with the member 58. After the screw 60 has been fastened in the holes 62 and 64, the blade portions 70 and 76 are "set", i.e., the portions 70 and 76 are bent so that cutting edges 92 will meet properly. Because of the employment of the bearing dimple 94, the time required for this blade "setting" operation is minimized, as compared to the time required to "set" the blades in prior art scissors, such as the scissors 20.

A number of scissors embodying the principles of my invention, such as the scissors 54, have been successfully made and used. Such usage has demonstrated that my improved scissor affords a cutting action comparable to that afforded by prior art scissors such as the scissors 20. In one such 5 inch scissor of my invention, the bearing dimple had a "height", i.e., projected from the surface of the inside face, a distance of 0.003 inches and was located 7/16 of an inch from the center of the screw hole. It has also been found that the cost of manufacturing my improved scissor, in accordance with my improved method, can be approximately one-third less than the cost of manufacturing a comparable prior art scissors utilizing conventional manufacturing methods.

In view of the foregoing, my improved tool, made in accordance with my improved method, represents an important advance in the art. In addition to affording considerable savings in manufacturing costs, the improved scissor of my present invention also has a highly desirable uniform "feel".

In conclusion, those having skill in this art will recognize that various modifications or changes could be made in the scissor 54. For example, the members 56 and 58 need not be structurally identical and of course the configuration or design of the handles and blade portions could be changed. The handles could be a separate part that is secured to the rest of the scissor member, and could be coated with plastic. Furthermore, the blade portions could be modified and rotated 90° so that the resulting tool could be used as a pickup tweezers.

Thus, since my invention disclosed herein may be embodied in other specific forms without departing from the spirit or central characteristics thereof, the preferred embodiment described herein are therefore to be considered in all respects as illustrative and not restrictive, the scope of my invention being indicated by the appended claims, rather than by the foregoing description of the preferred embodiment and all changes which come within the meaning and range of equivalency of the claims are intended to be embraced therein.

I claim:

1. An improved professional quality tool adapted for cutting, shearing and the like comprising:

first and second cooperating metal members, with each of the first and second members having a first end, a second end and a longitudinal central axis extending between their first and second ends;

a first handle on the first end of the first member;

a second handle on the first end of the second member;

means for interconnecting the first and second members at a connection point disposed between their first ends and their second ends for permitting the first and second members to pivotally move, with respect to each other and about the connection point, between a closed position wherein the second ends of the first and second members are adjacent to each other and an open position wherein the second ends of the first and second members are spaced from each other;

the first and second members each having a shank portion disposed adjacent to the connection point and between the connection point and their first ends, the shank portions each having an outside face, a leading edge that faces the leading edge of the other shank portion when the members are in their open positon, and an inside face that has a planar, substantially flat surface, with the flat, smooth surfaces of the inside faces of the shank portions of the first and second members being substantially parallel to each other but being spaced from each other a predetermined distance and substantially overlying each other as the first and second members approach their closed positions and while the first and second members are in their closed positions;

the first and second members each including a blade portion disposed between their second ends and the connection point, with each of the blade portions having an inside face, outside face and a cutting edge that is ground in the member from the second end of the member to adjacent to the connection point; and a single bearing dimple disposed on the inside face of the shank portion of one of the first and second members, the bearing dimple being a formed unitary portion of the one member, being positioned substantially between the leading edge and the longitudinal central axis of the one member and having a distal, rounded, projecting end that projects from the planar, substantially flat inside face of the shank portion of the one member, in a direction substantially perpendicular to the inside face, a distance greater than said predetermined distance so that the distal projecting end of the bearing dimple contacts the planar, substantially flat inside face of the shank portion of the other member as the first and second members approach their closed position and while the first and second members are in their closed position and so that as the sole result of the contact between the distal projecting end of the bearing dimple and the inside face of the shank portion of the other member, there is substantially point contact between the cutting edges of the first and second members as the first and second members move from their open position to their closed position, with this point contact being initially located adjacent to the point where the cutting edges initially intersect, and then moving out along the cutting edges to the second ends of the members as the first and second members continue to move to their closed position.

2. The improved tool described in claim 1 wherein the first and second members are substantialy identical except for the inclusion of the bearing dimple on the one member; and wherein the first and second members pivotally move about an axis which is generally coaxial with the axis of the interconnection means and which is generally perpendicular to the longitudinal axes of the first and second members.

3. The improved tool described in claim 2 wherein wherein the first and second members are made from stainless steel.

4. In a professional quality tool for cutting, shearing and the like comprising first and second cooperating metal members, with each of the first and second members having a first end, a second end and a longitudinal central axis extending between their first and second ends; a first handle on the first end of the first member; a second handle on the first end of the second member; means for interconnecting the first and second members at a connection point disposed between their first ends and their second ends for permitting the first and second members to pivotally move, with respect to each other and about the connection point, between a closed position wherein the second ends of the first and second members are adjacent to each other and an open position wherein the second ends of the first and second members are spaced from each other; the first and second members each having a shank portion disposed adjacent to the connection point and between the connection point and their first ends, the shank portions each having an outside face, a leading edge that faces the leading edge of the other shank portion when the members are in their open position, and an inside face that has a planar, substantially flat and smooth surface; the first and second members each including a blade portion disposed between their second ends and the connection point, with each of the blade portions having an inside face, outside face and a cutting edge that is ground in the member from the second end of the member to adjacent to the connection point; the improvement consisting of: the flat surfaces of the inside faces of the shank portions of the first and second members being substantially parallel to each other but being spaced from each other a predetermined distance and substantially overlying each other as the first and second members approach their closed positions and while the first and second members are in their closed positions; and a single bearing dimple disposed on the inside face of the shank portion of one of the first and second members, the bearing dimple being an unitary portion of the one member and having a distal, rounded, projecting end that projects from the planar, substantially flat inside face of the shank portion of the one member, in a direction substantially perpendicular to the inside face, a distance greater than said predetermined distance so that the distal projecting end of the bearing dimple contacts the substantially flat inside face of the shank portion of the other member as the first and second members approach their closed position and while the first and second members are in their closed position and so that as the sole result of the contact between the distal projecting end of the bearing dimple and the inside face of the shank portion of the other member, there is substantially point contact between the cutting edges of the first and second members as the first and second members move from their open position to their closed position, with this point contact being initially located adjacent to the point where the cutting edges initially intersect, and then moving out along the cutting edges to the second ends of the members as the first and second members continue to move to their closed position.

5. The improved tool described in claim 4 wherein the first and second members are substantially identical; wherein the first and second members pivotally move about an axis which is generally coaxial with the axis of the interconnecting means and which is generally perpendicular to the longitudinal axes of the first and second members; and wherein the first and second members are made from stainless steel.

6. The improved tool described in claim 4 wherein the bearing dimple is positioned substantially between the leading edge of the shank portion of the one member and the longitudinal central axis of the one member.

7. The improved tool described in claim 4 wherein the bearing dimple is a formed unitary portion of the one member.

8. An improved method of making a tool adapted for cutting, shearing and the like, which tool includes first and second pivotally interconnected, cooperating metal members that each have a first end and a second end, that are interconnected together, between their ends, at a connection point by interconnection means so as to permit the members to pivotally move with respect to each other about the connection point, that each include handles on their first ends, that each include a shank portion disposed between the connection point and the handle of the member, with each of the shank portions having an inside face and an outside face, and that each include a blade portion dispoed between the connection point and the second end of the member, with each of blade portions having an inside face, an outside face and a cutting edge extending from the second end of the member to adjacent to the connection point, the improved method comprising the steps of:

punching out blanks of the first and second members from a sheet of metal;

punching out the first ends of each of the first ends of each of the first and second member so as to form handle holes therein;

punching out each of the first and second member to form a hole that accommodates the the interconnection means and that is coaxial with the connection point;

punching the outside surface of the shank portion of one of the first and second members so as to form a bearing dimple on the inside surface of the shank portion of the one member;

heat treating the first and second member;

grinding and finishing the inside and outside faces of the blade portions, the cutting edges and the second ends of the first and second members so as to shape and point these second ends;

buffing and polishing the first and second members; and connecting the first and second members together by inserting the interconnection means in the holes aligned with the connection point.

9. The improved method described in claim 8 wherein the first and second member blanks are identical, and wherein the method includes offsetting the blanks so that they can cooperate together.

10. The improved method described in claim 8 wherein the interconnection means includes threads; and wherein at least one of the holes aligned with the connection point is threaded and countersunk.

11. The improved method described in claim 8 wherein the distance between the bearing dimple and the hole aligned with the connection point of the one member is at least equal to the distance between the hole and the cutting edge of the one member.

12. The improved method described in claim 11 wherein the first and second member blanks are identical; wherein the method includes offsetting the blanks so that they can cooperate together; wherein the interconnection means includes threads; and wherein at least one of the holes aligned with the connection point is threaded and countersunk.

* * * * *